United States Patent [19]

Schoumaker et al.

[11] Patent Number: 4,546,889

[45] Date of Patent: Oct. 15, 1985

[54] UNIVERSAL TELESCOPIC STRETCHER RAIL SYSTEM

[75] Inventors: Raoul J. P. Schoumaker, Wyoming; Mark A. Harter, Hamilton, both of Mich.

[73] Assignee: Westinghouse Electric Corp., Pittsburgh, Pa.

[21] Appl. No.: 519,631

[22] Filed: Aug. 2, 1983

[51] Int. Cl.[4] ..... A47H 1/08

[52] U.S. Cl. ..... 211/105.3; 52/632; 52/239

[58] Field of Search ..... 52/632, 239, 36, 241, 52/242, 243, 244; 160/379, 39; 211/105.4, 105.3, 123, 175, 208; 248/261, 262, 241

[56] References Cited

U.S. PATENT DOCUMENTS

| | | | |
|---|---|---|---|
| 678,637 | 7/1951 | Shannon | 52/632 |
| 2,546,929 | 3/1951 | Nampa | 52/243 |
| 3,759,297 | 9/1973 | Anderson et al. | 138/156 |
| 3,762,116 | 10/1973 | Anderson et al. | 52/239 |
| 4,018,019 | 4/1977 | Raith | 52/36 |
| 4,038,710 | 8/1977 | Tambascio | 52/632 |
| 4,158,936 | 6/1979 | Fulton | 52/242 |
| 4,349,113 | 9/1982 | Schreiner | 211/103 |
| 4,401,222 | 8/1983 | Kulikowski | 211/94 |

FOREIGN PATENT DOCUMENTS

| | | | |
|---|---|---|---|
| 1026921 | 2/1978 | Canada | 52/632 |

*Primary Examiner*—John E. Murtagh
*Assistant Examiner*—Kathryn Ford
*Attorney, Agent, or Firm*—B. R. Studebaker

[57] ABSTRACT

A universal stretcher rail system for use in connection with a space dividing wall panel system including wall panels of different lengths having vertically oriented, laterally spaced slotted standards at each end thereof. The system includes an inner rail member and a plurality of outer rail members of varying lengths each individually adapted to be selectively telescopically associated with the inner rail member to produce a stretcher rail of more than one predetermined length. L-shaped support brackets are fixed to the remote ends of the inner and outer rail members to interconnect the stretcher rail to a pair of laterally spaced slotted standards.

4 Claims, 5 Drawing Figures

UNIVERSAL TELESCOPIC STRETCHER RAIL SYSTEM

BACKGROUND OF THE INVENTION

In a free standing space dividing wall panel system of the type employed in the modern open office plan, desks and/or work surfaces of various types are still an essential element. In some systems, conventional free standing desks or work surface tables are employed which are not interconnected with the wall panel system. However, in many such systems the desks or work surfaces are mounted directly to the wall panel and are supported solely by the wall panel system. Several different mechanisms are utilized to mount the desk or work surface to the wall panel including L-shaped cantilever members and stretcher rails. A stretcher rail is a rail like member that is mounted flush against the panel and serves to support the edge of the desk or work surface which is against the wall panel. Since most wall panel systems include wall panels of a number of different lengths in order to provide for flexibility of office design, it is necessary to manufacture stretcher rails in as many different sizes as there are wall panel lengths in the system. Having to manufacture and inventory a number of different sized stretcher rails can involve substantial expense and a system which would allow stretcher rails to accommodate more than a single size panel would constitute a meaningful improvement in manufacturing and storage costs.

SUMMARY OF THE INVENTION

The problem of manufacturing and inventorying a number of different sized stretcher rails to accomodate a multitude of panel lengths in a system has been obviated to some extent by the universal stretcher rail system of this invention. In accordance with the present invention a universal stretcher rail system is provided for use in connection with a space dividing wall panel system which includes wall panels of different lengths having vertically oriented laterally spaced slotted standards of each end thereof. The stretcher rail system comprises an inner rail member and a plurality of hollow tubular outer rail members of varying lengths each individually adapted to be selectively associated with the inner rail member to produce a stretcher rail of a predetermined length. The inner rail member is telescopically received in the outer rail member and a first L-shaped mounting clip is secured along one leg to the outer surface of the inner rail member at one end thereof and a second L-shaped mounting clip is secured along one leg to the inner surface of the outer rail member at one end thereof. Connector means at the ends of the other legs of each of the first and second mounting clip means extend away from the rail member and are constructed and arranged to coact with the vertical slotted standards to mount the stretcher rail to the wall panel. The inner rail member is also hollow and end cap means are releasably retained in the remote ends of each of the inner and outer rail members thereby closing off the ends of the stretcher rail. Each of the inner and outer rail members are rectangular and the outer rail members include a plurality of key slots in the upper and lower surfaces thereof and the inner rail member includes a plurality of depressions in the upper and lower surfaces thereof constructed and arranged to align with the key slots in the outer rail members to facilitate attaching a desk, work surface or the like through the stretcher rail to the wall panel.

BRIEF DESCRIPTION OF THE DRAWING

Many of the attendant advantages of the present invention will become more readily apparent and better understood as the following detailed description is considered in connection with the accompanying drawing in which.

DESCRIPTION OF THE PREFERRED EMBODIMENT

Figure 1:
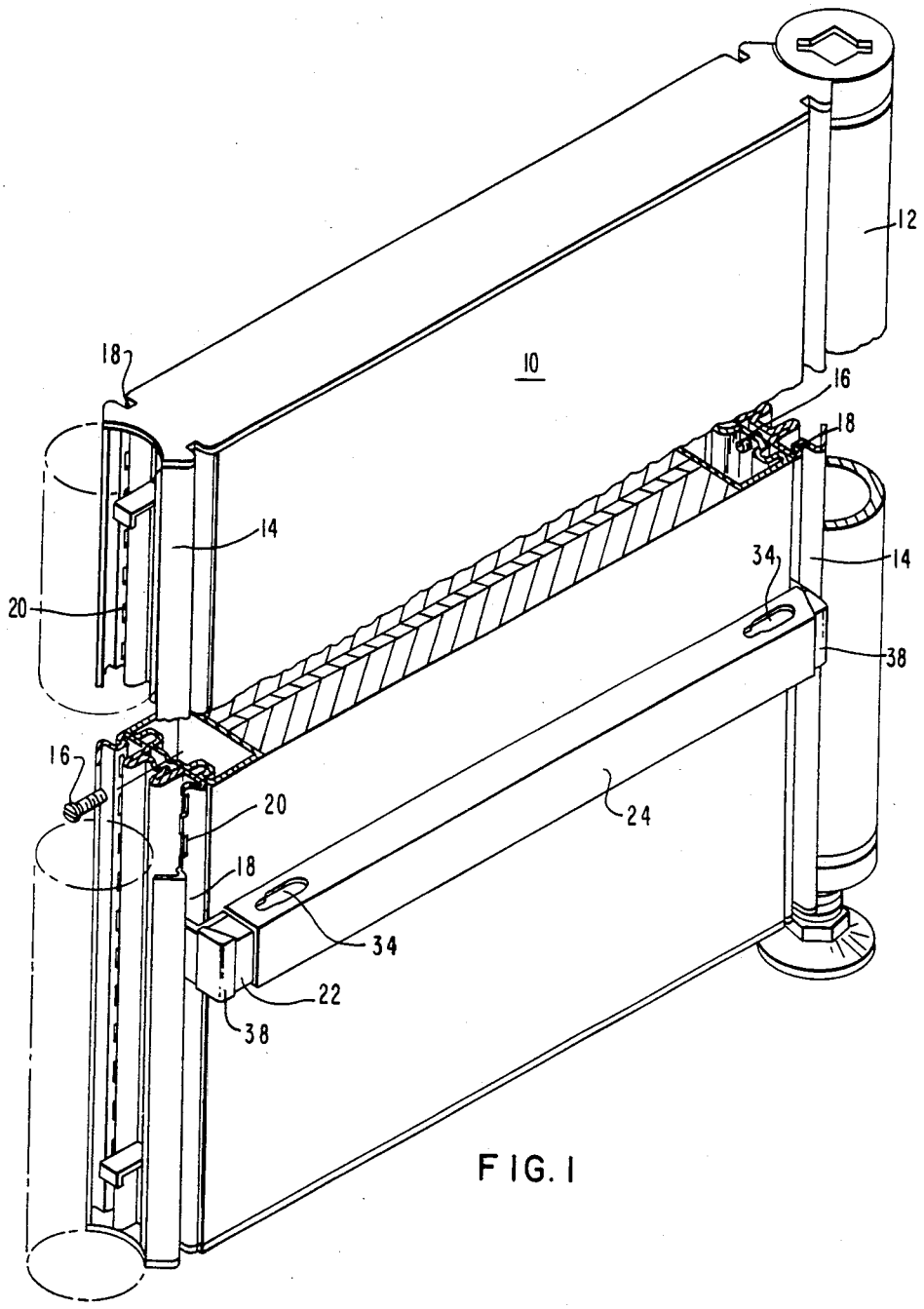
FIG. 1 is a perspective view of the stretcher rail of this invention mounted to a space dividing wall panel.

Referring now in detail to the drawing wherein like reference characters represent like parts throughout the several views there is illustrated in FIG. 1 a typical space dividing wall panel generally designated 10 of the type employing support posts 12 at the end of and between each associated panel. A more detailed description of a typical post supported panel system of the type illustrated may be found in U.S. Pat. No. 3,762,116 to William C. Anderson et al. for Space Divider System And Connector Assembly Therefore. Although the invention has been illustrated with respect to a post supported wall panel system it will be readily apparent that the universal telescopic stretcher rail of this invention may be utilized with any space dividing wall panel system either post supported or postless which includes at each end of the panel a slotted standard in the form of an end rail which includes therein a plurality of linearly aligned vertically oriented equidistantly spaced slots which extend for substantially the height of the space dividing wall panel.

As illustrated in FIG. 1, an end rail 14 is secured to each lateral edge of the panel as for example by screws 16. The slotted standard or end rail 14 includes a recessed channel therein 18 which at the base thereof a plurality of linearly aligned, equidistantly spaced, vertically oriented slots 20 which extend for substantially the height of the panel. These vertically aligned equidistantly spaced slots are employed in many panel systems for supporting various accessories on the wall panel as for example cabinetry, carriers for electrical and telephone wires, as well as desks and work surfaces.

Figure 2:
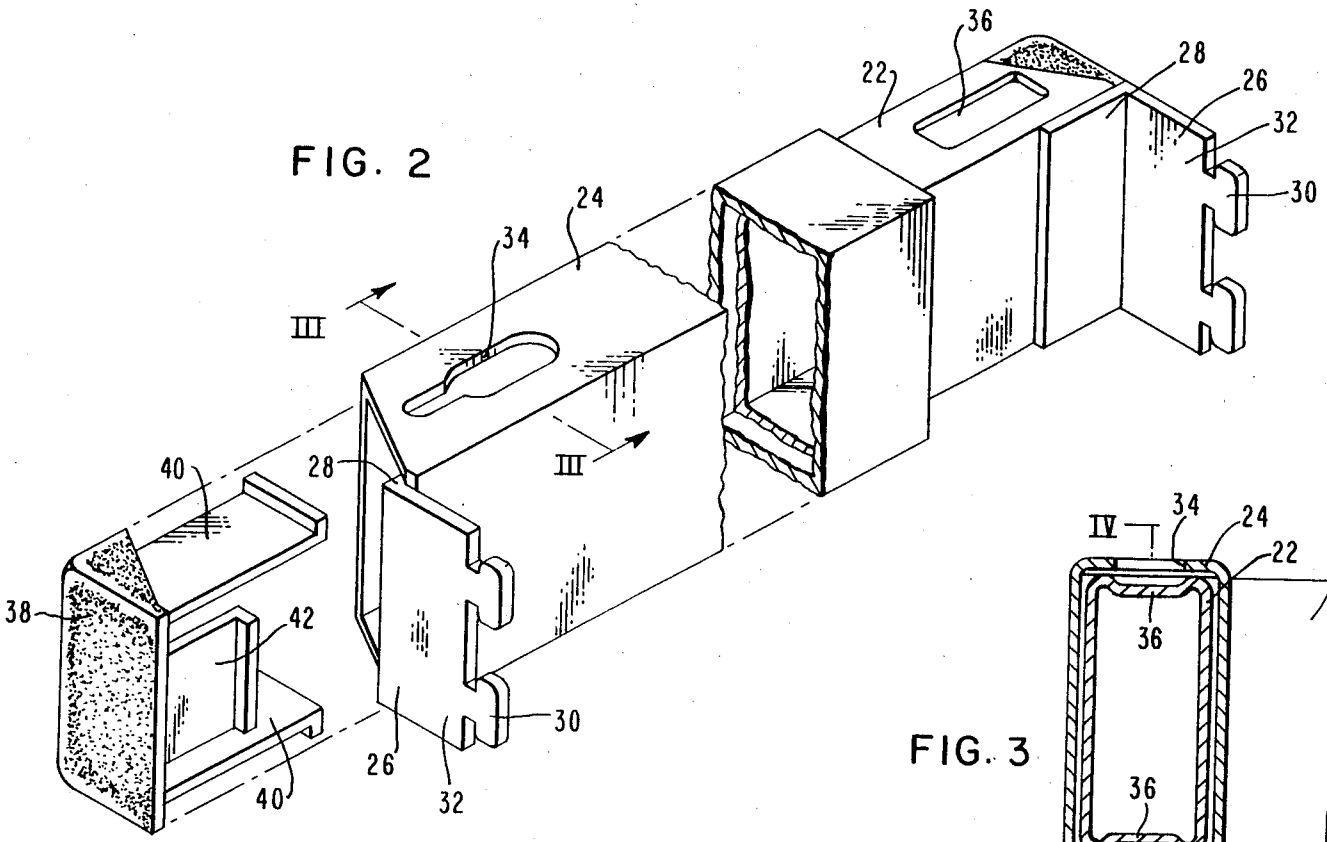
FIG. 2 is a partially exploded, partially broken away perspective view of the stretcher rail of this invention.

The stretcher rail of the present invention is designed for use in connection with a space dividing wall systems that employs two foot, three foot, four foot and five foot wide wall panels in various combinations to provide efficient open office plan layouts. It will be apparent that the concept of this invention is equally adaptable to wall panel systems which include a greater number of different wall panel widths than the four described above. The telescopic stretcher rail of this invention is best illustrated in FIG. 2 and includes an inner rail member 22 and an outer rail member 24 with the outer rail member 24 representing one of several different length outer rails. The inner rail 22 is telescopically received in the outer rail 24 to form the stretcher rail. Each of the inner and outer rail members are tubular hollow members, preferably rectangular in shape, and each of the inner and outer rails have welded thereto an L-shaped support bracket 26. The L-shaped support bracket 26 includes a first leg 28 which is welded to the outer surface of the inner rail member 22 and to the inner surface of the outer rail member 24. When a support bracket 26 is welded to the inner surface of the outer rail member and a second L-shaped support bracket 26 is welded to the outer surface of the inner rail member 22, the T-shaped connectors 30 on the second leg 32 of the L-shaped support bracket will lie in the same plane and consequently when the stretcher rail is mounted to a slotted standard the inner surface of the outer rail member will lie flush against the space dividing wall panel 10 over its entire length.

Both the upper and lower surfaces of the outer rail member are provided with key shaped slots 34 therethrough while the inner rail member 22 is provided with complementary depressions 36 in both its upper and lower surfaces.

End cap members 38 are employed to close off the open ends of the tubular inner and outer rail members. The end caps 38 include upper and lower resilient retaining members 40 along with a lateral resilient retaining member 42 which serve to releasably retain the end caps 38 in the ends of the tubular rail members. On the inner rail member, the upper and lower resilient retaining members 40 snap over the edges of depressions 36 and on the outer rail member the resilient retaining member 42 snaps over the inner edge of the leg 28 of the L-shaped support bracket 26.

Figure 3:
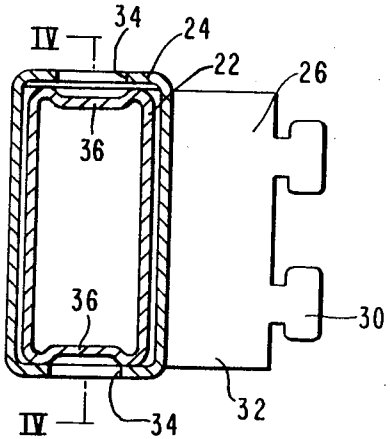
FIG. 3 is a sectional view taken along the line III—III of FIG. 2.

The rail members 22 and 24 along with the L-shaped mounting brackets 26 are preferably of steel with the welds connecting the mounting brackets to the rail members being designed to withstand 300 pounds of sheer load. The end caps 38 are preferably polyproylene or a similar plastic material with a textured outside surface as illustrated in FIGS. 2 and 3. The connectors 30 on the leg 32 of the L-shaped support bracket are preferably T-shaped as opposed to the hook shaped connectors sometimes employed for these purposes in order to render the stretcher rail of this invention non-handed. The key shape slots 34 in the outer rail and depressions 36 of the inner rail are provided in both the top and bottom sides of the rail members to further facilitate the non-handed aspect of this invention. The purpose of the key shaped slots and depressions are to facilitate the mounting of a desk top or work surface to the stretcher rail by means of screws or bolts having heads which extend through the larger portion of the key slot and are locked into connection by sliding the screw head into the smaller portion of the key slot 34. The depressions 36 allow space between the inner and outer rails to accommodate the screw heads.

Figure 5:
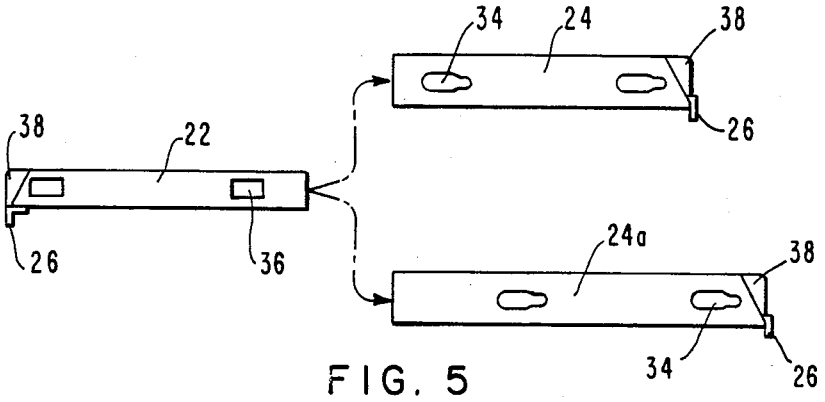
FIG. 5 is a schematic view illustrating the various parts of the stretcher rail system of this invention.
Figure 4:
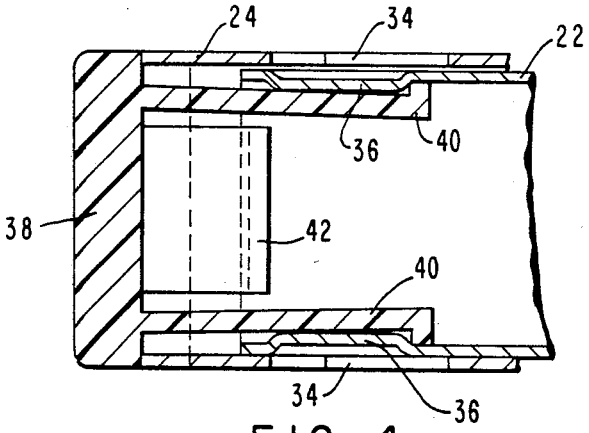
FIG. 4 is a sectional view taken along the line IV—IV of FIG. 3.

As best seen in FIG. 5, a single inner rail member 22 may be combined with the outer rail member 24 to form a two foot or three foot stretcher rail and when a stretcher rail is needed in connection with a space dividing wall panel which is four feet or five feet in length the outer rail 24A may be employed.

As will be apparent from the foregoing the universal telescopic stretcher rail of this invention will substantially reduce the requirement for stretcher rail inventories by providing a system whereby a plurality of outer rail members of different lengths can be combined individually with a standard inner rail member to accommodate requirements for stretcher rails of various lengths. Furthermore, the stretcher rail is non-handed and may be mounted with the inner rail member on either the left or right hand side as requirements may dictate.

What is claimed is:

1. A wall hung, telescoping stretcher rail for use in connection with a free standing, space dividing, wall panel system having laterally spaced vertical slotted standards, said stretcher rail comprising:

an inner rail member;

a hollow tubular outer rail member adapted to telescopically receive said inner rail member;

a first L-shaped mounting clip secured along one leg thereof to the outer surface of said inner rail member adjacent one end thereof;

a second L-shaped mounting clip secured along one leg thereof to an inner surface of said outer rail member adjacent one end thereof; and connector means at the ends of the other legs of each of said first and second mounting clips extending away from said rail members, said connector means constructed and arranged to coact with said vertical slotted standards to mount said stretcher rail to said wall panel.

2. The wall hung telescoping stretcher rail according to claim 1 wherein each of said inner and outer rail members are rectangular and said outer rail member includes a plurality of key slots in the upper and lower surfaces thereof, said inner rail member including a plurality of depressions in the upper and lower surfaces thereof constructed and arranged to align with said key slots in said outer rail member.

3. A universal stretcher rail system for use in connection with a space dividing wall panel system including wall panels of different lengths having vertically oriented laterally spaced slotted standards at each end thereof, said stretcher rail system comprising:

an inner rail member;

a plurality of hollow tubular outer rail members of varying lengths each individually adapted to be selectively associated with said inner rail member to produce a stretcher rail of a predetermined length, said inner rail member being telescopically received in said outer rail member;

a first L-shaped mounting clip secured along one leg thereof to the outer surface of said inner rail member;

a second L-shaped mounting clip secured along one leg thereof to an inner surface of said outer rail member; and connector means at the ends of the other legs of each of said first and second mounting clips extending away from said rail members, said connector means constructed and arranged to coact with said vertical slotted standard to mount said stretcher rail to said wall panel.

4. The universal stretcher rail system of claim 3 wherein each of said inner and outer rail members are rectangular and said outer rail members include a plurality of key slots in the upper and lower surfaces thereof, said inner rail member including a plurality of depressions in the upper and lower surfaces thereof constructed and arranged to align with said key slots in said outer rail members.

* * * * *